US005173066A

United States Patent [19]

Umeda

[11] Patent Number: 5,173,066

[45] Date of Patent: Dec. 22, 1992

[54] CHIP HOLDER FIXING DEVICE

[75] Inventor: Shigeru Umeda, Tokyo, Japan

[73] Assignee: Obara Corporation, Tokyo, Japan

[21] Appl. No.: 754,762

[22] Filed: Sep. 4, 1991

[30] Foreign Application Priority Data

Jan. 24, 1991 [JP] Japan ..... 3-6426[U]

[51] Int. Cl.[5] ..... H01R 4/30

[52] U.S. Cl. ..... 439/803; 439/919; 219/86.25; 219/86.8

[58] Field of Search ..... 219/86.8, 86.1, 86.23, 219/86.24, 158, 161, 86.25; 439/801-803, 919, 863, 864, 677, 668, 669

[56] References Cited

U.S. PATENT DOCUMENTS

| | | | |
|---|---|---|---|
| 2,093,079 | 9/1937 | Nixon | 439/864 |
| 2,137,011 | 11/1938 | Bleibtreu | 439/863 |
| 4,128,295 | 12/1978 | Bunnell | 439/864 |
| 4,215,911 | 8/1990 | Dittman et al. | 439/863 |

*Primary Examiner*—David L. Pirlot

*Attorney, Agent, or Firm*—Flynn, Thiel, Boutell & Tanis

[57] ABSTRACT

A chip holder fixing device comprising an arm having a circular hole defined therein into which a rear portion of a chi8p holder is inserted. The chip holder is fastened to the arm by way of a bolt. The arrangement assures the positioning of the chip holder relative to the arm and the prevention of the chip holder from turning.

2 Claims, 3 Drawing Sheets

CHIP HOLDER FIXING DEVICE

BACKGROUND OF THE INVENTION

1. Field of the Invention

The present invention relates to a device for fixing a chip holder to an arm of a spot welding gun.

2. Prior Art

A conventional device for fixing a chip holder to an arm of a spot welding gun (hereinafter referred to as chip holder fixing device) is illustrated in FIGS. 3 and 4 and FIGS. 5 and 6.

The conventional chip holder fixing device as illustrated in FIGS. 3 and 4 comprises an arm 11 having a circular hole 12 defined by boring a tip end thereof and a projection 14 defined by partly protruding from the tip end thereof. The projection 14 has a lower surface 13 extending from the upper portion of the circular hole 12 tangentially to the circular hole 12. A chip holder 15 has a rear portion having a notched plain surface 16 which is brought into contact with a lower surface 13 of the projection 14. A cylindrical portion 17 is defined at the rear potion of the chip holder 15 which is inserted into the circular hole 12 of the arm 11.

The rear portion of the chip holder 15 having a chip (not shown) at the tip end thereof can be inserted into the circular hole 12 of the arm 11 so that an electric current from the arm 11 can be supplied to the chip by way of the chip holder 15. The chip holder 15 can be prevented from turning by permitting the notched plain surface 16 to bring into contact with the projection 14.

The chip holder fixing device as illustrated in FIGS. 5 and 6 comprises an arm 21 having a circular hole 22 defined by boring the tip end thereof and a first notched groove 23 at the portion adjacent to the tip end portion thereof. A chip holder 24 has a second notched groove 25 cooperative with the notched groove 23 at the rear end thereof. A member 26 for preventing the chip holder 24 from turning is embedded inside the first and second notched grooves 23 and 25 and fixed to the arm 21 by screws 27.

However, there was a problem in the former conventional device that inasmuch as the cylindrical portion 17 of the chip holder 15 is brought into contact with an entire circumference of the circular hole 12, conductivity is high but rigidity serving for preventing the chip holder 24 from turning is low. Furthermore, a breakage caused by concentrated stress is liable to occur, especially the projection 14 is liable to break. In the latter conventional device, although the rigidity serving for preventing the chip holder 24 from turning is high, the conductivity is low because only one side of the chip holder 24 is pressed against one portion of the inner periphery of the arm and the breakage caused by concentrated stress is liable to occur.

SUMMARY OF THE INVENTION

The present invention has been made to solve the problems of the conventional devices and is to provide a chip holder fixing device having a high rigidity serving for preventing the chip holder from turning and a high conductivity while avoiding the breakage caused by concentrated stress.

To achieve the above object, the chip holder fixing device according to the present invention comprises an arm for spot welding gun having a recessed hole, a chip holder having a rear portion which is inserted into and fixed to the recessed hole of the arm wherein the recessed hole of the arm comprises a first circular hole having a large diameter and a second circular hole having a small diameter and eccentric relative to the first circular hole. The rear portion of the chip holder has a first cylindrical portion having a large diameter which portion is inserted into the first circular hole of the recessed hole and a second cylindrical portion having a small diameter which portion is inserted into the second circular hole of the recessed hole and eccentric to the first cylindrical portion.

DESCRIPTION OF THE PREFERRED EMBODIMENT

Figure 1:
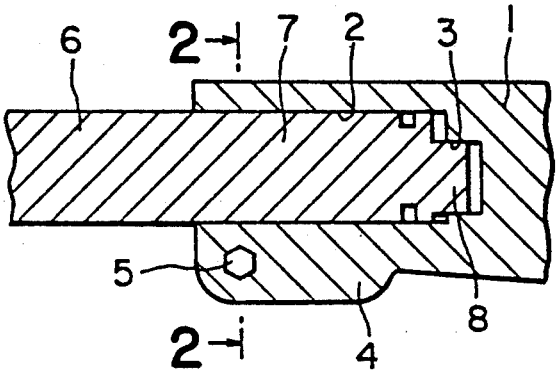
FIG. 1 is a cross sectional view of a chip holder fixing device according to a preferred embodiment of the present invention.
Figure 2:
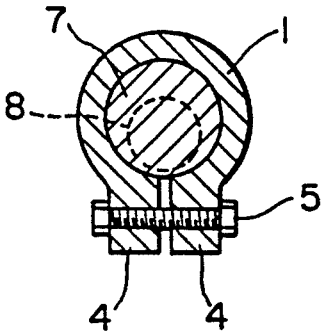
FIG. 2 is a cross sectional view taken along 2—2 of the chip holder fixing device in FIG. 1.
Figure 3:
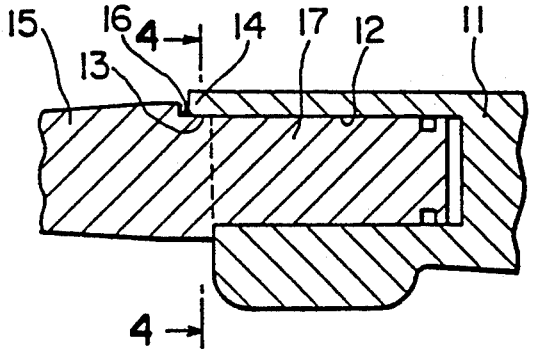
FIG. 3 (PRIOR ART)
FIG. 3 is a cross sectional view of a conventional chip holder fixing device.
Figure 4:
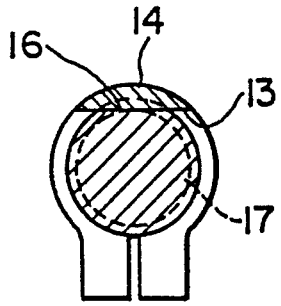
FIG. 4 (PRIOR ART)
FIG. 4 is a cross sectional view taken along 8—8 of the conventional chip holder fixing device in FIG. 3.
Figure 5:
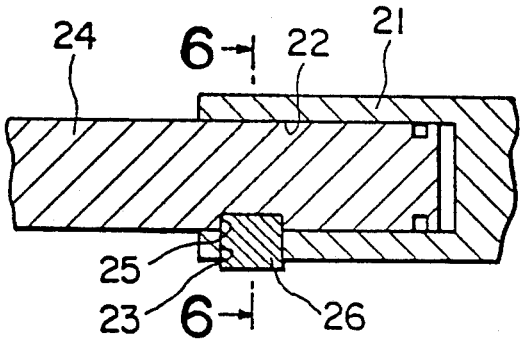
FIG. 5 (PRIOR ART)
FIG. 5 is a cross sectional view of another conventional chip holder fixing device.
Figure 6:
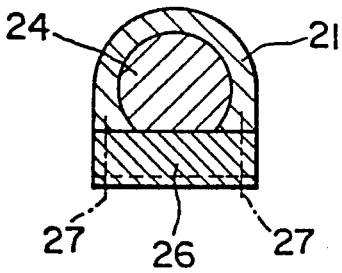
FIG. 6 (PRIOR ART)
FIG. 6 is a cross sectional view taken along 6—6 of another conventional chip holder fixing device in FIG. 5.

A chip holder fixing device according to a preferred embodiment of the present invention will be described with reference to FIGS. 1 and 2.

The chip holder fixing device comprises an arm 1 for spot welding gun having a recessed hole defined by boring a tip end thereof and composed of a first circular hole 2 having a large diameter and a second circular hole 3 having a small diameter which is eccentric to the first circular hole 2. The arm 1 has a lower portion 4 splitted into two portions each having a screw hole. After a chip holder 6 is inserted into the first circular hole 2, a bolt is screwed into the screw hole of the splitted portions of the lower portion 4 so that the chip holder 6 is firmly fixed to the arm 1.

The chip holder 6 has a chip at a front tip end thereof (not shown). The chip holder 6 further has a first cylindrical portion 7 having a large diameter which is inserted into the first circular hole 2 and a second cylindrical portion 8 having a small diameter which is eccentric relative to the first cylindrical portion 7 and inserted into the second circular hole 3.

The second cylindrical portion 8 serves for positioning the chip holder 6 and preventing the chip holder 6 from turning since the second cylindrical portion 8 having the small diameter is inserted into the second circular hole 3 having the small diameter while the first cylindrical portion 7 having the large diameter is inserted into the first circular hole 2 having the large diameter when the rear portion of the chip holder 6 is inserted into and fixed to the recessed hole of the arm 1.

After the rear portion of the chip holder 6 is inserted into the recessed hole of the arm 1, the bolt 5 is screwed into the screw holes of the splitted portion 4 of the arm 1 so that the chip holder 6 is firmly fixed to the arm 1.

With the arrangement of the chip holder fixing device, the cylindrical portion of the chip holder having the small diameter effectively serves for positioning the chip holder relative to the arm with accuracy and for preventing the chip holder from turning.

Inasmuch as the cylindrical portions of the chip holder are brought into contact with the entire periphery of the recessed hole of the arm, conductivity is high. Furthermore, inasmuch as the eccentric cylindrical portion of the chip holder having small diameter is inserted into the eccentric circular hole of the arm having the small diameter, rigidity serving for preventing the chip holder from turning is high. Still furthermore, inasmuch as there is no portion where stress is concentrated, there is no anxiety about the breakage of the chip holder.

What is claimed is:

1. A chip holder fixing device comprising:

an arm having a recessed hole, the recessed hole composed of a first circular hole having a large diameter and a second circular hole having a small diameter and eccentic relative to the first circular hole; and a chip holder having a rear portion which is inserted into the recessed hole of the arm, the rear portion having a first cylindrical portion having a large diameter which is inserted into the first circular hole of the recessed hole and a second cylindrical portion having a small diameter which is inserted into the second circular hole of the recessed hole and eccentric to the first cylindrical portion of the rear portion of the chip holder.

2. A chip holder fixing device according to claim 1, wherein the arm has a lower portion which is split into two parts, each said part having a screw hole through which a bolt is screwed after the chip holder is inserted into the recessed hole of the arm.

* * * * *